US005338227A

United States Patent [19]

Nakamura

[11] Patent Number: 5,338,227

[45] Date of Patent: Aug. 16, 1994

[54] PLUG-TYPE MULTIPOLAR ELECTRICAL CONNECTOR

[75] Inventor: Masahiko Nakamura, Yao, Japan

[73] Assignee: Hosiden Corporation, Yao, Japan

[21] Appl. No.: 22,318

[22] Filed: Feb. 25, 1993

[30] Foreign Application Priority Data

Mar. 25, 1992 [JP] Japan ..... 4-015664[U]

[51] Int. Cl.[5] ..... H01R 13/648

[52] U.S. Cl. ..... 439/607; 439/352; 439/682

[58] Field of Search ..... 439/98, 108, 352, 607, 439/610, 682, 752, 874

[56] References Cited

U.S. PATENT DOCUMENTS 4,929,189 5/1990 Sekiguchi ..... 439/610 X
5,021,012 6/1991 Shibano ..... 439/610
5,088,932 2/1992 Nakamura ..... 439/610 X
5,195,910 3/1993 Enomoto et al. ..... 439/874

FOREIGN PATENT DOCUMENTS 2186748 8/1987 United Kingdom ..... 439/752

*Primary Examiner*—Khiem Nguyen
*Attorney, Agent, or Firm*—Jones, Tullar & Cooper

[57] ABSTRACT

A plug-type multipolar electrical connector is arranged such that a composite cable comprising, as core wires, thin and thick wires can be connected to respective terminal pins in a limited space and that a shielding operation as an anti-noise measure is improved. Thus, the plug-type multipolar electrical connector can be miniaturized with higher density and improved in shielding performance. The horizontal pitch between each adjacent terminal pin for thick wires is coarser or greater than the horizontal pitch between each adjacent terminal pin for thin wires. A terminal pin group for thin wires is disposed at the center of a body, and a terminal pin group for thick wires is disposed at a lateral side of the terminal pin group for thin wires. The terminal pin groups are enveloped by shield covers.

6 Claims, 12 Drawing Sheets

PLUG-TYPE MULTIPOLAR ELECTRICAL CONNECTOR

This application corresponds to copending, commonly owned application, Ser. No. 08/022,319, filed Feb. 25, 1993.

BACKGROUND OF THE INVENTION

1. Field of the Invention

The present invention relates to a plug-type multipolar electrical connector to be used together with its counter connector or socket-type multipolar electrical connector, and more particularly to a plug-type multipolar electrical connector in which, without hindrance for various types of signal processings, the pitch between the adjacent terminal pins is minimized to miniaturize the connector with the density of the terminal pins increased.

2. Description of the Prior Art

As shown in FIG. 14, a composite cable 100 capable of executing various types of signal processings has a complicated arrangement in which a braided shell shield 110 comprising a braided aluminum foil surrounds insulating coated conductors 121, 131 which can be twisted to form small-diameter conductors (thin conductors) and insulating coated conductors 141 which can be twisted to form large-diameter conductors (thick conductors).

In each of a plug-type multipolar electrical connector and its counter connector or socket-type multipolar electrical connector, there is required a complicated handling of conductors that the tips of the insulating coated conductors 121, 131, 141 are twisted to form thick and thin conductors and each of the thick and thin conductors is connected to the corresponding terminal pin.

A conventional plug-type multipolar electrical connector is so arranged as to be used for a composite cable including several conductors of one type having the same diameter (i.e, thin conductors). To use such a conventional plug-type multipolar electrical connector for the composite cable 100 as shown in FIG. 14, it is required to provide a space necessary for handling thick conductors. Accordingly, the connector is inevitably increased in size in its entirety. This cannot meet the recent demand for a miniaturized electrical connector with higher density.

On the other hand, a multipolar electrical connector for a composite cable including thin and thick conductors is used for executing various types of signal processings. Accordingly, an anti-noise measure which is actually taken exerts a great influence upon the performance of the electrical connector. Also, great importance is set on the maneuverability of attaching to and removing from a counter connector or socket-type multipolar electrical connector, as well as the performance of preventing the plug-type connector as connected to a socket-type connector from being unexpectedly disconnected therefrom.

SUMMARY OF THE INVENTION

The present invention is proposed in view of the foregoing.

It is an object of the present invention to provide a plug-type multipolar electrical connector which can be used for a composite cable as shown in FIG. 14, while effectively restrained from being increased in size.

It is another object of the present invention to provide a plug-type multipolar electrical connector having an excellent performance for shielding noise.

It is a further object of the present invention to provide a plug-type multipolar electrical connector which is excellent in its maneuverability for attaching to and removing from its counter connector or socket-type multipolar electrical connector, and also excellent in its performance of preventing the plug-type multipolar electrical connector as attached to its counter connector from being unexpectedly disconnected therefrom.

To achieve the objects mentioned above, the present invention provides a plug-type multipolar electrical connector having a body made of an insulating material in which a plurality of terminal pins are assembled and project in the forward direction. This plug-type multipolar electrical connector is characterized in that the plurality of terminal pins comprises: a terminal pin group for thin conductors in which a plurality of terminal pins are disposed at the center of the body with the horizontal pitch between each adjacent terminal pin being fine; and a terminal pin group for thick conductors in which a plurality of terminal pins are disposed at a lateral side of the terminal pin group for thin conductors with the horizontal pitch between each adjacent terminal pin being coarse.

According to the plug-type multipolar electrical connector of the present invention having the arrangement mentioned above, the terminal pin group for thin conductors arranged such that the horizontal pitch of each adjacent terminal pin is fine, is disposed at the center of the body, and the terminal pin group for thick conductors arranged such that the horizontal pitch of each adjacent terminal pin is coarse, is disposed at a lateral side of the terminal pin group for thin conductors. Accordingly, a thin conductor group pulled out from a composite cable can be gathered to the center of the body, and a thick conductor group can be gathered to a lateral side of the thin conductor group. This eliminates wasted space in the space in which the thin conductor group is to be handled, thus enabling the plug-type multipolar electrical connector to be miniaturized. Accordingly, the present invention can provide a plug-type multipolar electrical connector which can be used for a composite cable having thin conductors and thick conductors and which satisfies the demand for miniaturization and higher density.

According to the present invention, the plug-type multipolar electrical connector may have: a first shield cover made of a metallic plate and so disposed as to surround the body, the terminal pin group for thin conductors and the terminal pin group for thick conductors; a ring body fittingly put on a composite cable in which a braided shell shield surrounds core wires comprising thin conductors and core wires comprising thick conductors; and a second shield cover having, in a unitary structure, (i) an attaching neck portion fittingly put on the ring body attached to the composite cable, a portion of the braided shell shield folded back on the outer surface of the ring body being held by and between the attaching neck portion and the ring body, and (ii) a fitting case portion extending from the attaching neck portion and fitted to the first shield cover.

According to the plug-type multipolar electrical connector having the arrangement mentioned above, the braided shell shield of the composite cable, the second shield cover and the first shield cover are securely electrically connected to one another. Accordingly, the connector is made in a compact design and provides excellent shielding performance as an anti-noise measure. Thus, the present invention can provide a plug-type multipolar electrical connector which is in conformity with the demand for miniaturization and higher density and which exhibits excellent shielding performance as an anti-noise measure.

According to the present invention, the plug-type multipolar electrical connector may comprise: a pair of lateral plates formed at the first shield cover; openings formed in the lateral plates, the openings being long in the longitudinal direction of the lateral plates; locking members having, in a unitary structure, resilient movable pieces provided at the front ends thereof with projections and at the base ends thereof with holding frames having spaces for housing spring members; sliders having, in a unitary structure, base portions longitudinally movably fitted to the holding frames of the locking members, and slide pieces extending from the base portions throughout the back sides of the movable pieces in an overlapping manner; spring members disposed in the spaces for housing spring members in the holding frames between the base portions of the sliders and spring receiving portions formed at the holding frames, the spring members normally biasing the sliders in the forward direction; and a sleeve longitudinally slidably put on and fitted to the first shield cover, the sleeve having an engagement portion which is engageable, only from the front side thereof, with the front ends of the base portions of the sliders; the locking members being fitted to the openings with the projections of the movable pieces projecting from the lateral plates of the first shield cover; the holding frames of the locking members being engaged with the rear end edges of the openings; and the engagement portions of the front ends of the base portions of the sliders with the engagement portion of the sleeve, being located rearward with respect to the projections of the movable pieces.

According to the plug-type multipolar electrical connector having the arrangement mentioned above, the first shield cover and the locking members are independent from each other, the locking members are fitted into the openings formed in the lateral plates of the first shield cover and the spring members are housed in the holding frames of the locking members. Accordingly, the openings in the first shield cover are substantially perfectly closed by the locking members. Thus, even though the connector is provided with a locking function, the connector is excellent in shielding performance.

Further, when the sliders are removed, there are formed, at the back sides of the movable pieces of the locking members, spaces in which the movable pieces can be bent. Further, when the sleeve is removed with respect to the first shield cover, the engagement portion of the sleeve is engaged with the base portions of the sliders, thus removing the sliders.

Accordingly, the present invention can provide a plug-type multipolar electrical connector which is provided with a locking function without hurting the shielding operation, which is excellent in maneuverability of attaching to and removing from its counter connector or socket-type multipolar electrical connector, and which is also excellent in preventing the plug-type multipolar electrical connector as connected to the socket-type multipolar electrical connector from being unexpectedly disconnected therefrom.

These and other features, objects and advantages of the present invention will be more fully apparent from the following description of embodiments thereof.

DETAILED DESCRIPTION OF THE PREFERRED EMBODIMENTS

Figure 1:
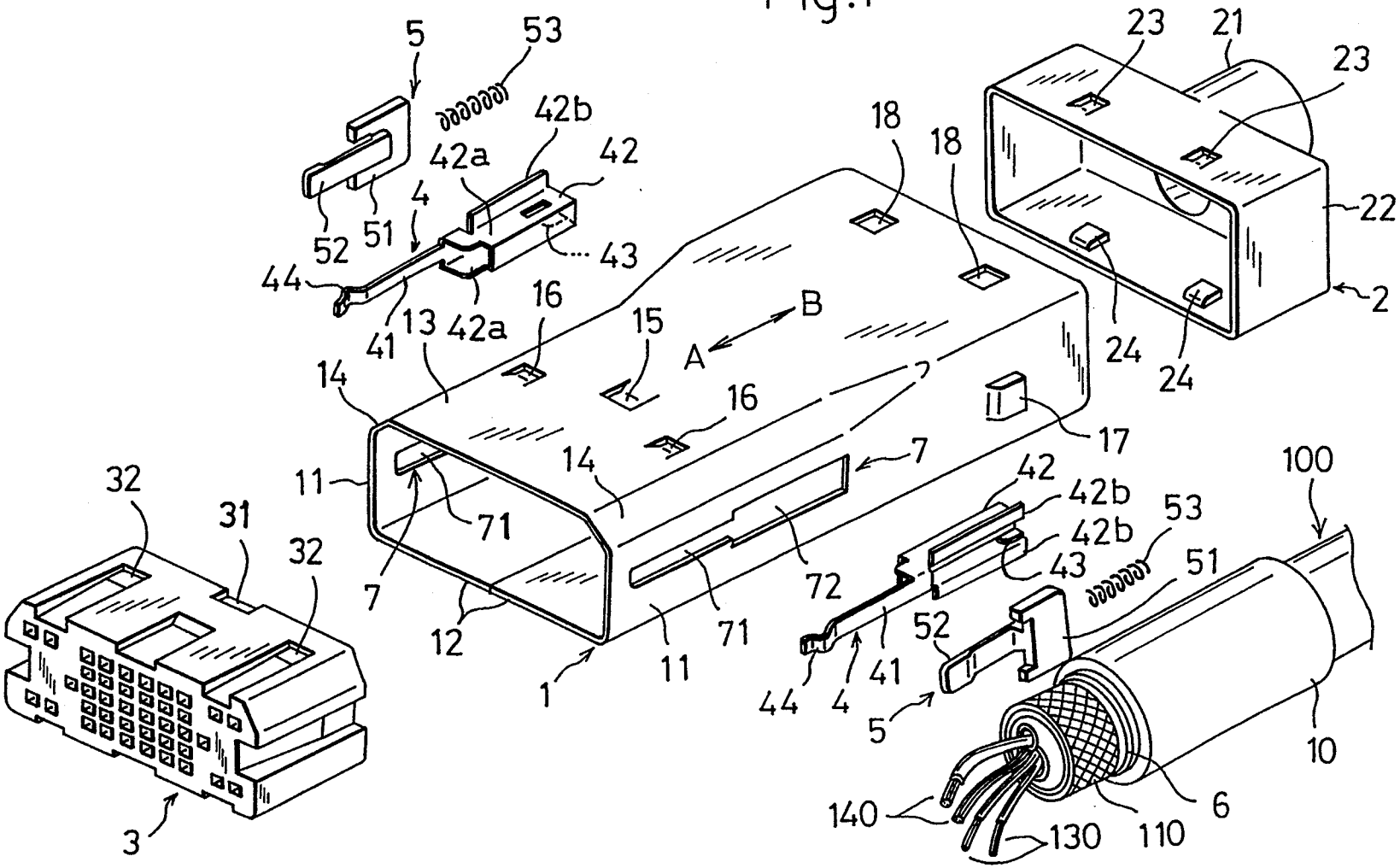
FIG. 1 is an exploded perspective view of a composite cable and portions of a plug-type multipolar electrical connector according to the present invention.

In FIG. 1, a plug-type multipolar electrical connector has a first shield cover 1, a second shield cover 2, a body 3, locking members 4, sliders 5 and the like.

Figure 3:
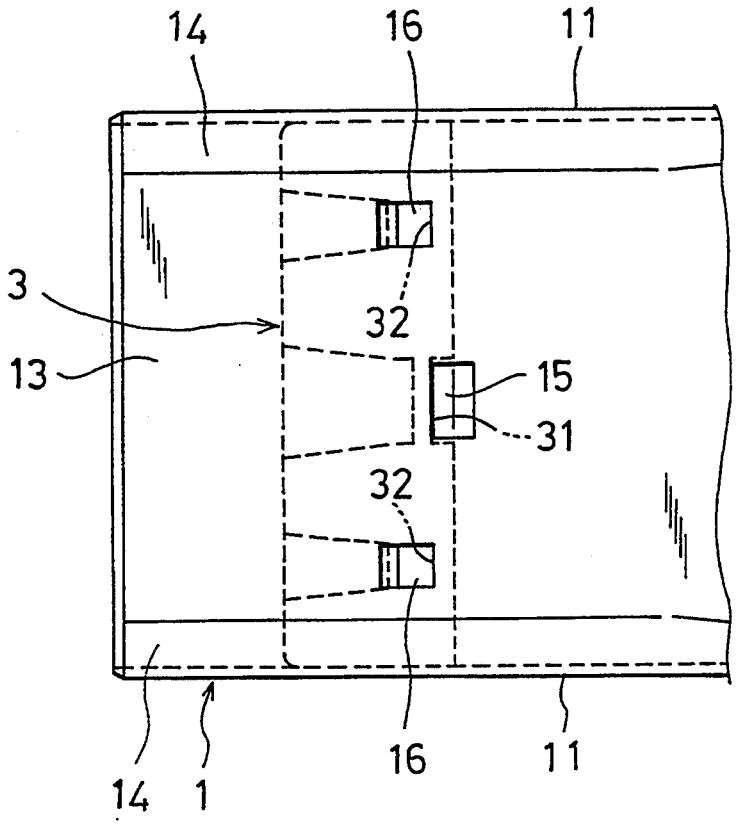
FIG. 3 is a plan view illustrating the connection of a first shield cover to a body.

The first shield cover 1 is formed by bending a metallic plate into a rectangular case. The first shield cover 1 is provided at the front end portion thereof with a pair of lateral plates 11, a bottom plate 12, a top plate 13, and inclined plates 14 between the top plate 13 and the lateral plates 11. The top plate 13 has an engagement pawl 15 opened in the forward direction A and engagement pawls 16 opened in the rearward direction B, these engagement pawls 15, 16 being formed as cut and inwardly turned. Although not shown, the bottom plate 12 also has an engagement pawl opened in the forward direction A and engagement pawls opened in the rearward direction B, these engagement pawls being formed also as cut and inwardly turned. The shape in front elevation of the first shield cover 1 at the front end portion thereof is the same as that of the body 3 shown in FIGS. 1 and 4. Thus, the body 3 is fitted into the front end portion of the first shield cover 1. The body 3 is provided at the top side and the underside thereof with stepped engagement portions 31, 32. By engaging these stepped engagement portions 31, 32 with the corresponding engagement pawls 15, 16, the body 3 is connected to the first shield cover 1 as shown in FIG. 3. It is noted that FIG. 1 does not show the stepped engagement portions formed in the underside of the body 3.

In the first shield cover 1, the lateral plates 11 are provided at the rear end portions thereof with engagement pawls 17 ( See FIGS. 1 and 5 ) which are formed as cut and outwardly turned and which are opened in the rearward direction. In the first shield cover 1, the top plate 13 and the bottom plate 12 are provided at the rear end portions thereof with engagement holes 18, 19 (See FIGS. 1 and 5).

Figure 5:
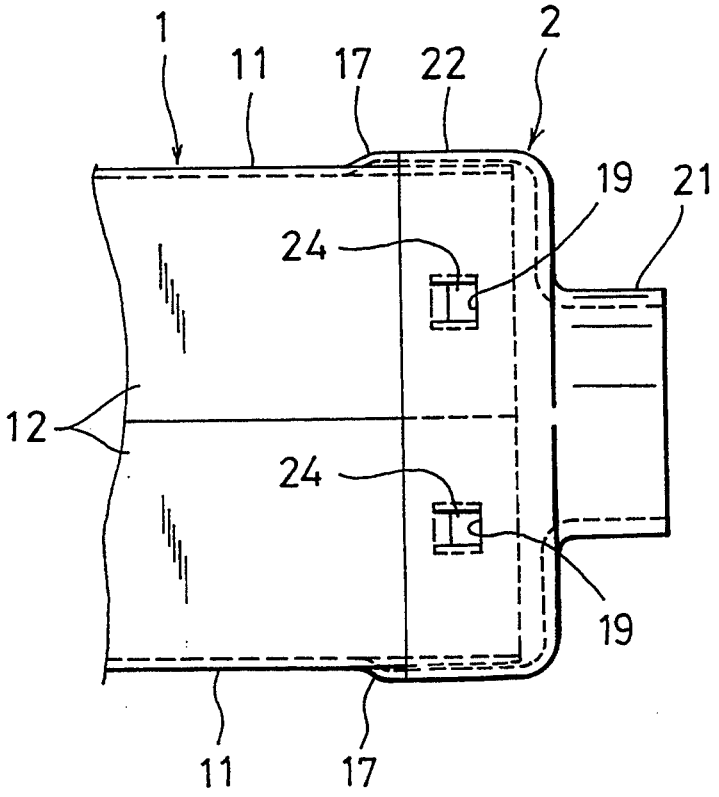
FIG. 5 is a plan view illustrating the connection of the first shield cover to a second shield cover.

The second shield cover 2 is formed by drawing a metallic plate. The second shield cover 2 has, in a unitary structure, an attaching neck portion 21 and a fitting case portion 22 extending therefrom. The fitting case portion 22 has the same shape as that of the rear end portion of the first shield cover 1 and has sizes such that the rear end portion of the first shield cover 1 can be fitted into the fitting case portion 22. The second shield cover 2 has engagement pawls 23, 24 which are formed as cut and inwardly turned and which are opened in the rearward direction. When the rear end portion of the first shield cover 1 is fitted into the fitting case portion 22 of the second shield cover 2, these engagement pawls 23, 24 are respectively engaged with the corresponding engagement holes 18, 19 in the first shield cover 1, and the engagement pawls 17 of the first shield cover 1 are engaged with the front end edges of the fitting case portion 22 as shown in FIG. 5. Thus, the first shield cover 1 is connected to the second shield cover 2. The fitted portions (i.e., the overlapping portions) of the first shield cover 1 and the second shield cover 2 may be soldered to each other to improve the shielding performance.

Figure 6:
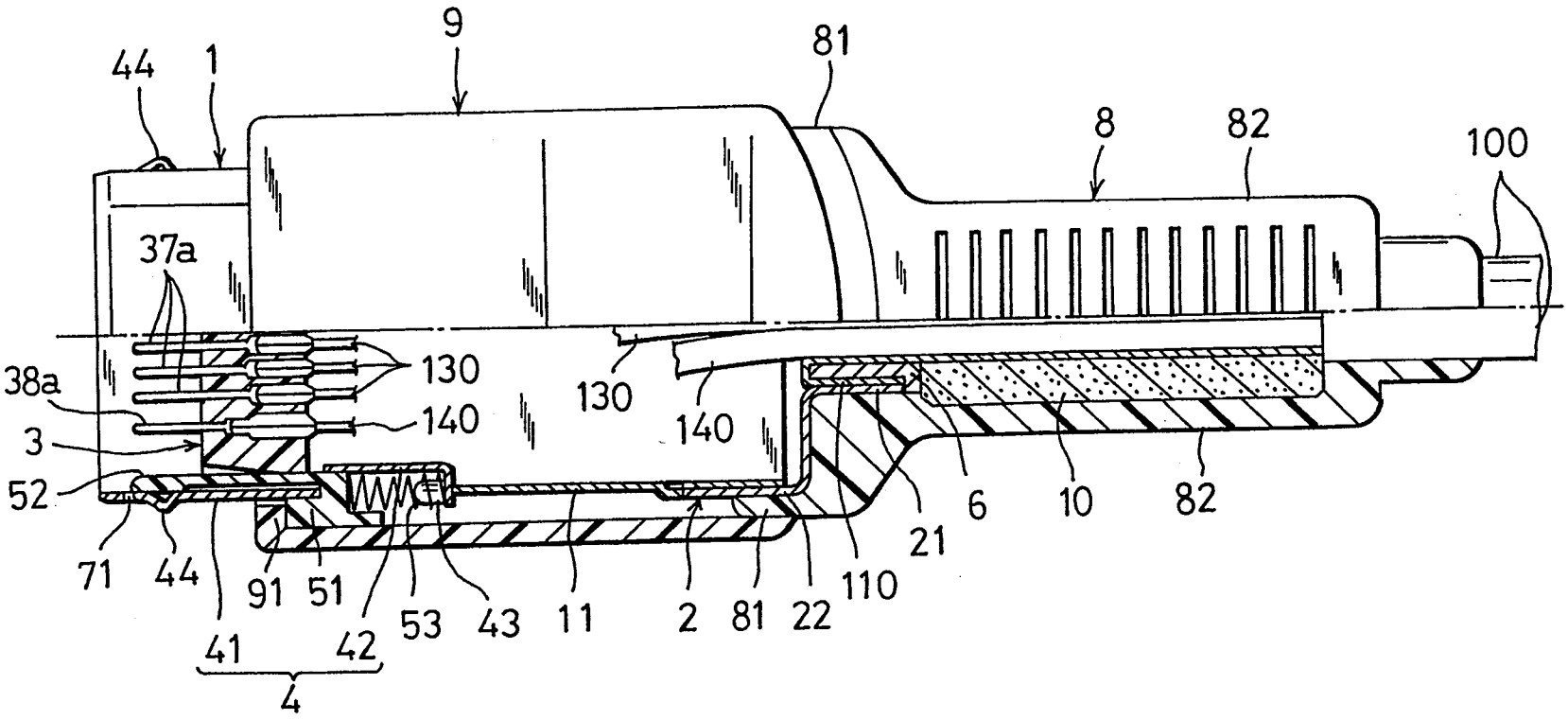
FIG. 6 is a plan view, with portions broken away, of the plug-type multipolar electrical connector according to the present invention.
Figure 14:
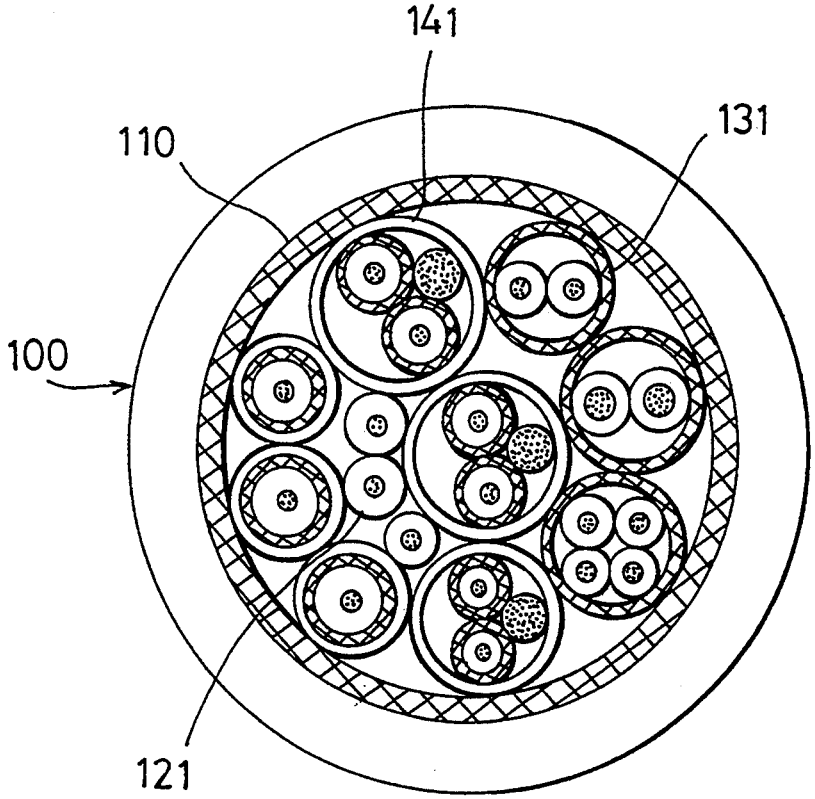
FIG. 14 id a section view of a composite cable.

A composite cable 100 is of the same type as that discussed in connection with FIG. 14, and comprises thin conductors 130 and thick conductors 140 incorporated in a braided shell shield 110. As shown in FIGS. 1 and 6, the composite cable 100 is provided in the vicinity of the tip thereof with a ring body 6 put thereon. A portion of the braided shell shield 110 is folded back on the outer surface of the ring body 6. The attaching neck portion 21 of the second shield cover 2 is put on the ring body 6, and the braided shell shield 110 is held by and between the ring body 6 and the attaching neck portion 21. Accordingly, the second shield cover 2 is securely electrically contacted with the braided shell shield 110. This improves the shielding operation of the connector in an area including the first shield cover 1. When the attaching neck portion 21 is calked or the overlapping portions of the ring body 6 and the braided shell shield 110 are soldered to each other, the shielding operation is further improved.

Figure 4:
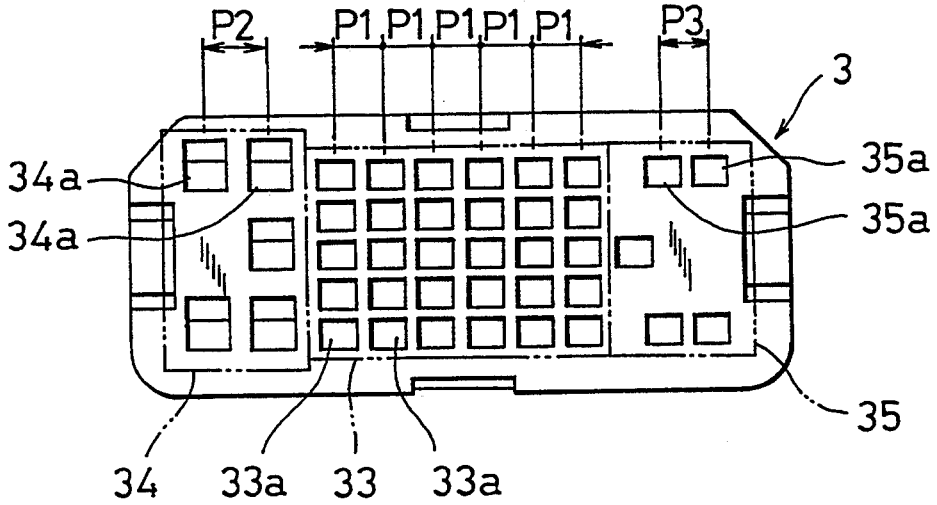
FIG. 4 is a back view of the body.

The body 3 is molded from an insulating resin. A number of horizontal terminal pin attaching holes are formed as arranged in a grid manner in both the transverse and longitudinal directions. As shown in FIG. 4, out of these terminal pin attaching holes, a first attaching hole group 33 formed at the center of the body 3 has first attaching holes 33*a* in which the horizontal pitch P1 between each adjacent holes is fine. A second attaching hole group 34 at one side of the first attaching hole group 33 has second attaching holes 34*a* in which the horizontal pitch P2 between each adjacent hole is coarse or greater. A third attaching hole group 35 at the other side of the first attaching hole group 33 has third attaching holes 35*a* in which the horizontal pitch P3 between each adjacent hole is fine. In the embodiment mentioned above, P1 is equal to P3 which is smaller than P2. As shown in FIG. 6, terminal pins 37*a*, 38*a* are inserted into the first attaching holes 33*a*, the second attaching holes 34*a* and the third attaching holes 35*a* such that the terminal pins 37*a*, 38*a* project in the forward direction A. The terminal pins 37*a* inserted into the first attaching hole group 33 and into the third attaching hole group 35 are used for thin conductors, and the terminal pins 38*a* inserted into the second attaching hole group 34 are used for thick conductors. Accordingly, the terminal pins 37*a* for thin conductors form a thin conductor terminal pin group at each of the center and the other side of the body 3, and the terminal pins 38*a* for thick conductors form a thick conductor terminal pin group at one side of the body 3. The thin conductors 130 exposed at the tip of the composite cable 100 are gathered to the center and the other side of the body 3 and respectively connected to the corresponding thin conductor terminal pins 37*a*, and the thick conductors 140 are gathered to one side of the body 3 and respectively connected to the corresponding thick conductor terminal pins 38*a*.

With such handling of conductors, the thin conductors 130 and the thick conductors 140 are not mixed, and a space necessary for handling the thin conductors 130 can be reduced. This restrains the body 3 and consequently the plug-type multipolar electrical connector from being increased in size. Thus, the plug-type multipolar electrical connector satisfies the demand for miniaturization and higher density.

As shown in FIG. 1, the first shield cover 1 is provided in each of the lateral plates 11 with an opening 7 which extend in the longitudinal direction A–B. Each opening 7 has a forward narrow-width part 71 and a rearward wide-width part 72. Each locking member 4 has, in a unitary structure, a resilient movable piece 41 and a holding frame 42 integrally formed the base end of the movable piece 41. A projection 44 is formed by bending the tip of each movable piece 41. In each holding frame 42, a space for housing a spring member 53 is formed between a pair of upper and lower flat plates 42*a*, and flange portions 42b are formed by bending the flat plates 42*a*. A tongue-like spring receiving portion 43 is formed at the rear end of each holding frame 42. In each slider 5, a slide piece 52 projects from the lateral side of a base portion 51.

Figure 7:
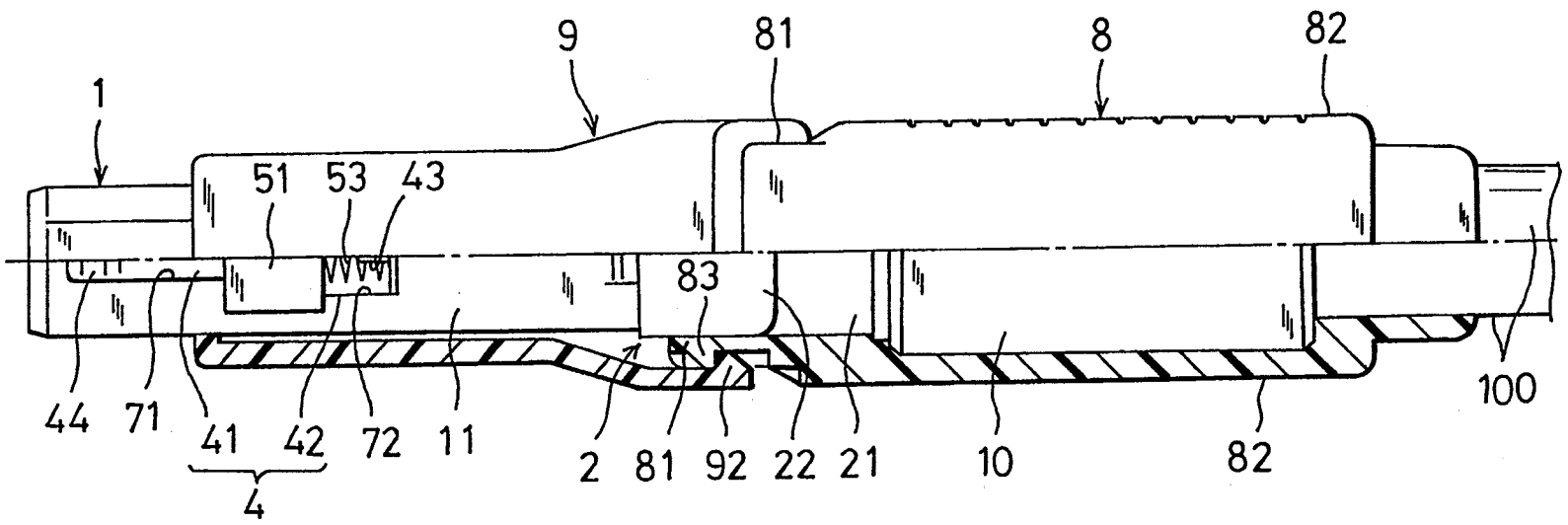
FIG. 7 is a side view, with portions broken away, of the plug-type multipolar electrical connector according to the present invention.

As shown in FIGS. 6 and 7, the locking members 4 are fitted into the openings 7 of the first shield cover 1. At this time, the movable pieces 41 of the locking members 4 are housed in the narrow-width parts 71, the projections 44 project from the lateral plates of the first shield cover 1, and the holding frames 42 are fitted into the wide-width parts 72 in the openings 7. The flange portions 42*b* are opposite and come in contact with the outer surfaces of the lateral plates 11, engagement pawls (not shown) formed at the flat plates 42*a* are engaged with the inner surfaces of the lateral plates 11, so that the holding frames 42 are secured to the lateral plates 11. The slide pieces 52 of the sliders 5 are disposed in an overlapping manner throughout the back sides of the movable pieces 41 of the locking members 4 attached the first shield cover 1, and the base portions 51 of the sliders 5 are longitudinally movably fitted to the holding frames 42 of the locking members 4. The spring members 53 comprising coil springs are interposed and compressed between the base portions 51 of the sliders 5 and the spring receiving portions 43 formed in the holding frames 42 of the locking members 4. The spring members 53 normally bias the sliders 5 in the forward direction A.

Figure 2:
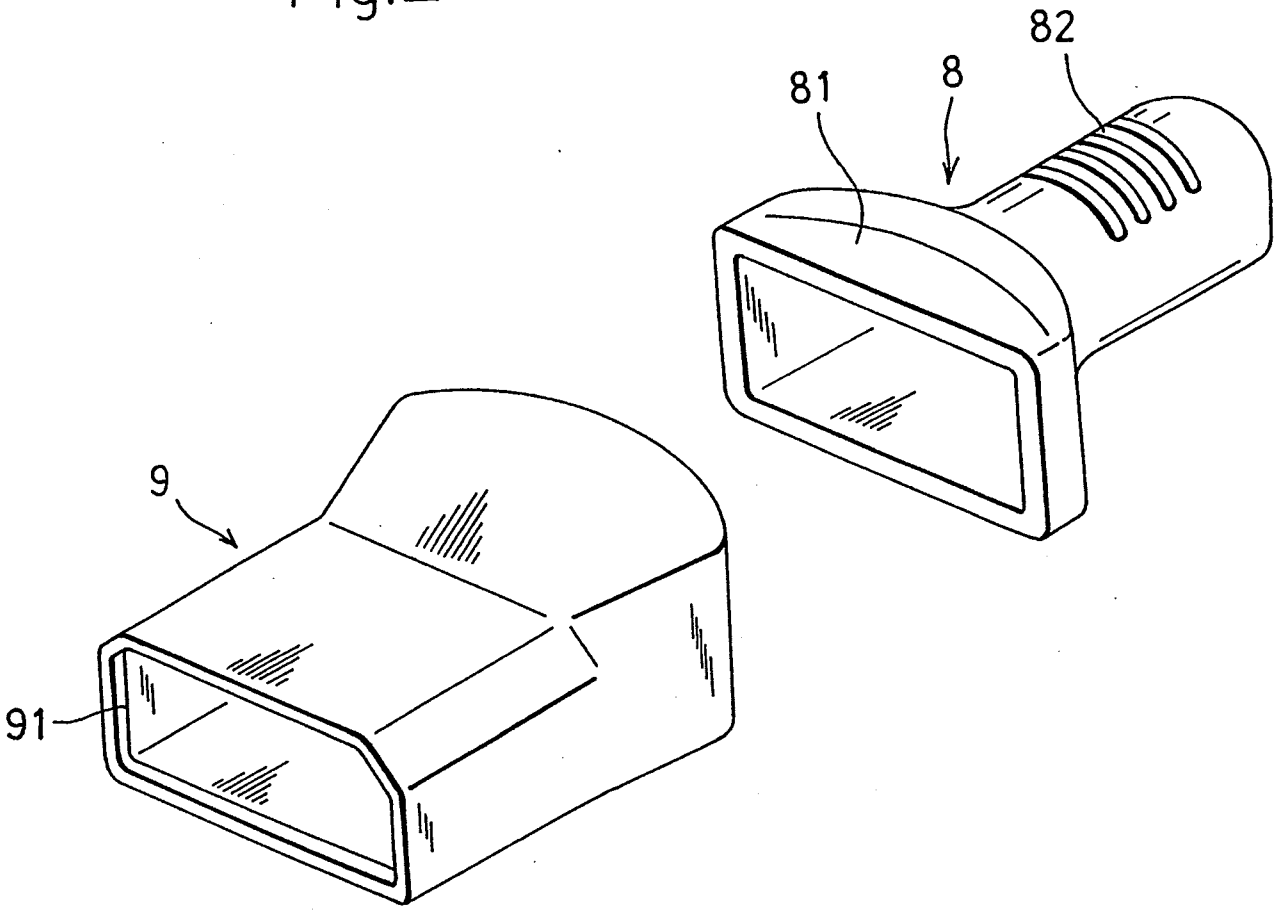
FIG. 2 is an exploded perspective view of a strain relief and a sleeve.

FIG. 2 shows a strain relief 8 and a sleeve 9. The strain relief 8 has a cover portion 81 and a case portion 82. As shown in FIGS. 6 and 7, the cover portion 81 is put on the second shield cover 2, and the case portion 82 covers the composite cable 100 in such a manner as to envelop a ferrite core 10 put on the composite cable 100. As the strain relief 8, a molded article may be used mounted on the second shield cover 2 and the composite cable 100 as mentioned above, or the strain relief 8 may be formed by injection molding.

The sleeve 9 is made in the form of a case the shape of which is similar to the shape in front elevation of the first shield cover 1. The sleeve 9 is longitudinally slidably placed on the first shield cover 1. The rear end portion of the sleeve 9 is slidably placed on the cover portion 81 of the strain relief 8. The sleeve 9 is provided at the inner periphery of the front end thereof with an inwardly projecting engagement portion 91. As shown in FIG. 6, the engagement portion 91 is disposed rearward with respect to the projections 44 such that the engagement portion 91 is engageable, only from the front side thereof, with the front ends of the base portions 51 of the sliders 5. As shown in FIG. 7, the sleeve 9 is provided at the rear end thereof with an engagement pawl 92. This engagement pawl 92 is opposite to a stepped engagement portion 83 of the cover portion 81 of the strain relief 8, thus preventing the sleeve 9 from coming off.

Figure 8:
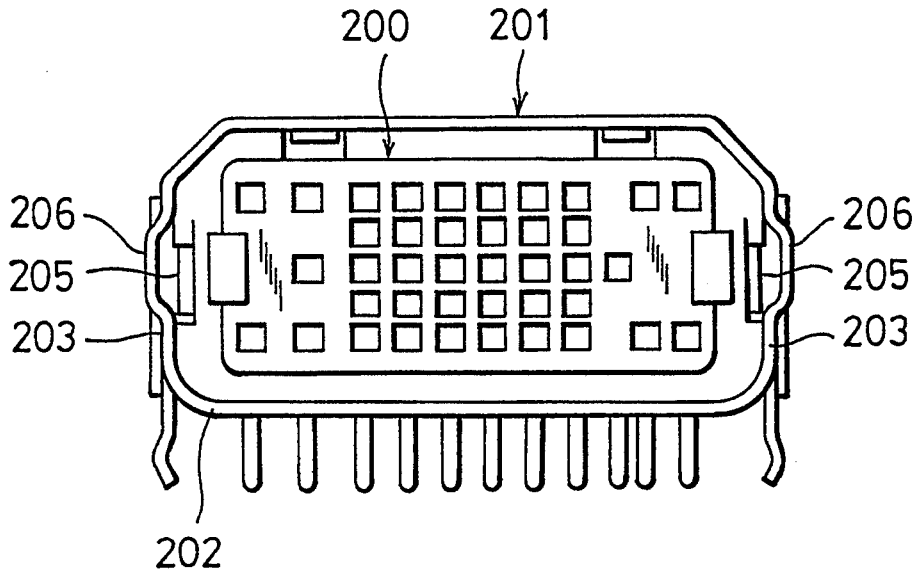
FIG. 8 is a front view of a socket-type multipolar electrical connector.
Figure 9:
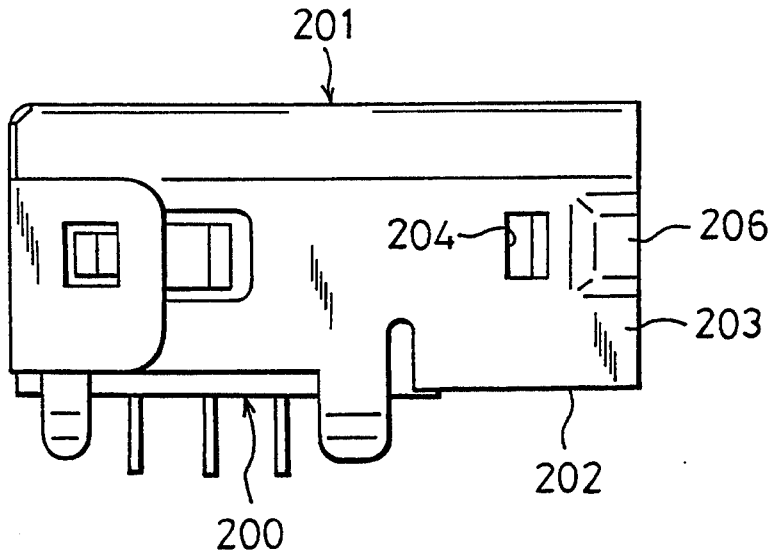
FIG. 9 is a side view of the socket-type multipolar electrical connector.

With reference to FIGS. 8 and 9, the following description will discuss the arrangement of a socket-type multipolar electrical connector which is a counter electrical connector of the plug-type multipolar electrical connector.

A socket-type multipolar electrical connector comprises a shield cover 201 and a body 200 fitted therein. The shield cover 201 is formed by bending a metallic plate. The shield cover 201 has a rectangular case portion 202 having a pair of lateral plates 203, each of which is provided with an engagement hole 204 and an expanded guide 206. The body 200 is provided on the lateral sides thereof with projecting portions 205. Predetermined gaps are formed between the projecting portions 205 and the lateral plates 203 of the shield cover 201. It is a matter of course that the body 200 has terminal pin groups (not shown) corresponding to the terminal pin groups of the body 3 of the plug-type multipolar electrical connector above-mentioned.

With reference to FIGS. 10 to 13, the following description will discuss how the plug-type multipolar electrical connector is connected to the socket-type multipolar electrical connector and how the both connectors as connected are disconnected from each other.

Figure 10:
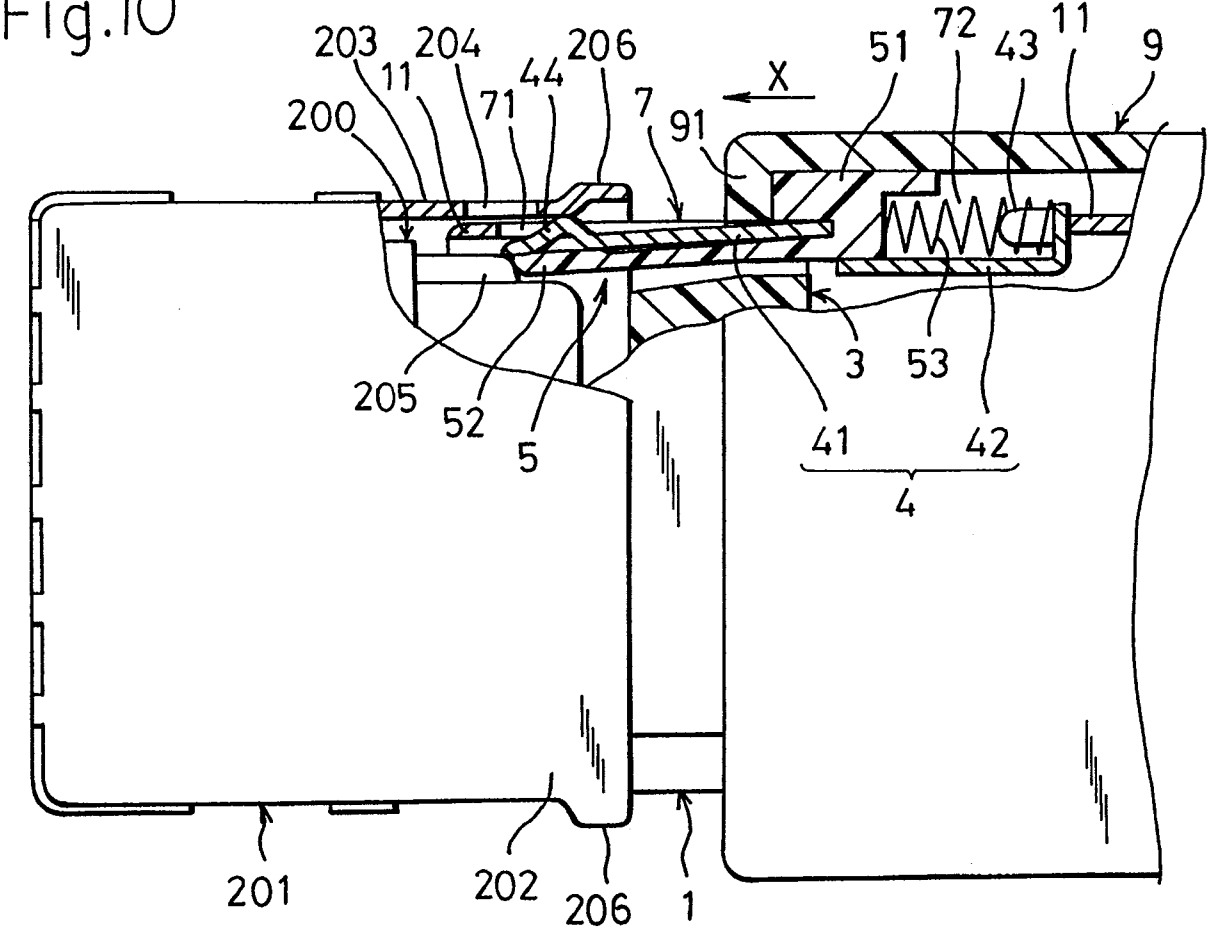
FIG. 10 is a view, with portions broken away, illustrating a stage of an operation of connecting the plug-type multipolar electrical connector to the socket-type multipolar electrical connector
Figure 11:
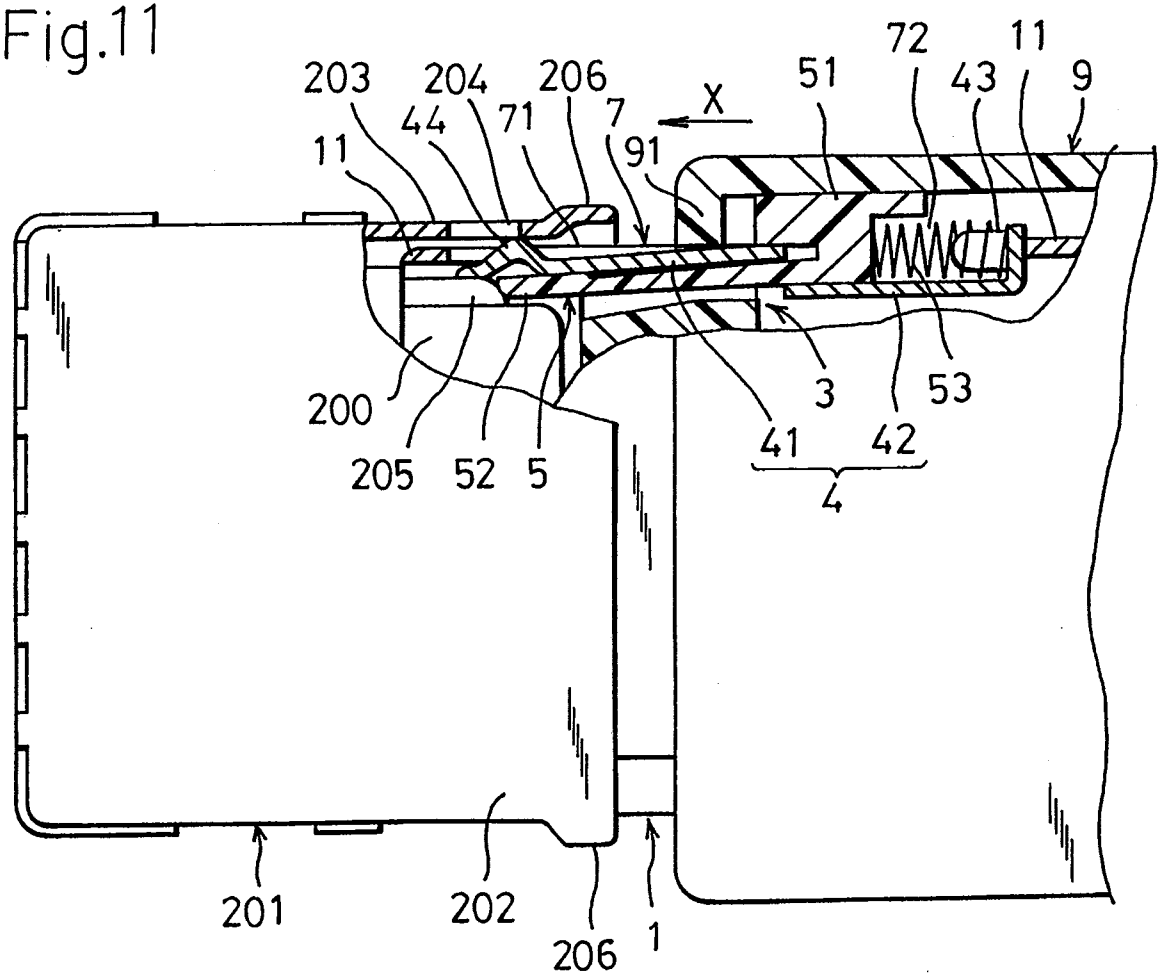
FIG. 11 is a view illustrating another stage of the operation of connecting the plug-type multipolar electrical connector to the socket-type multipolar electrical connector.
Figure 12:
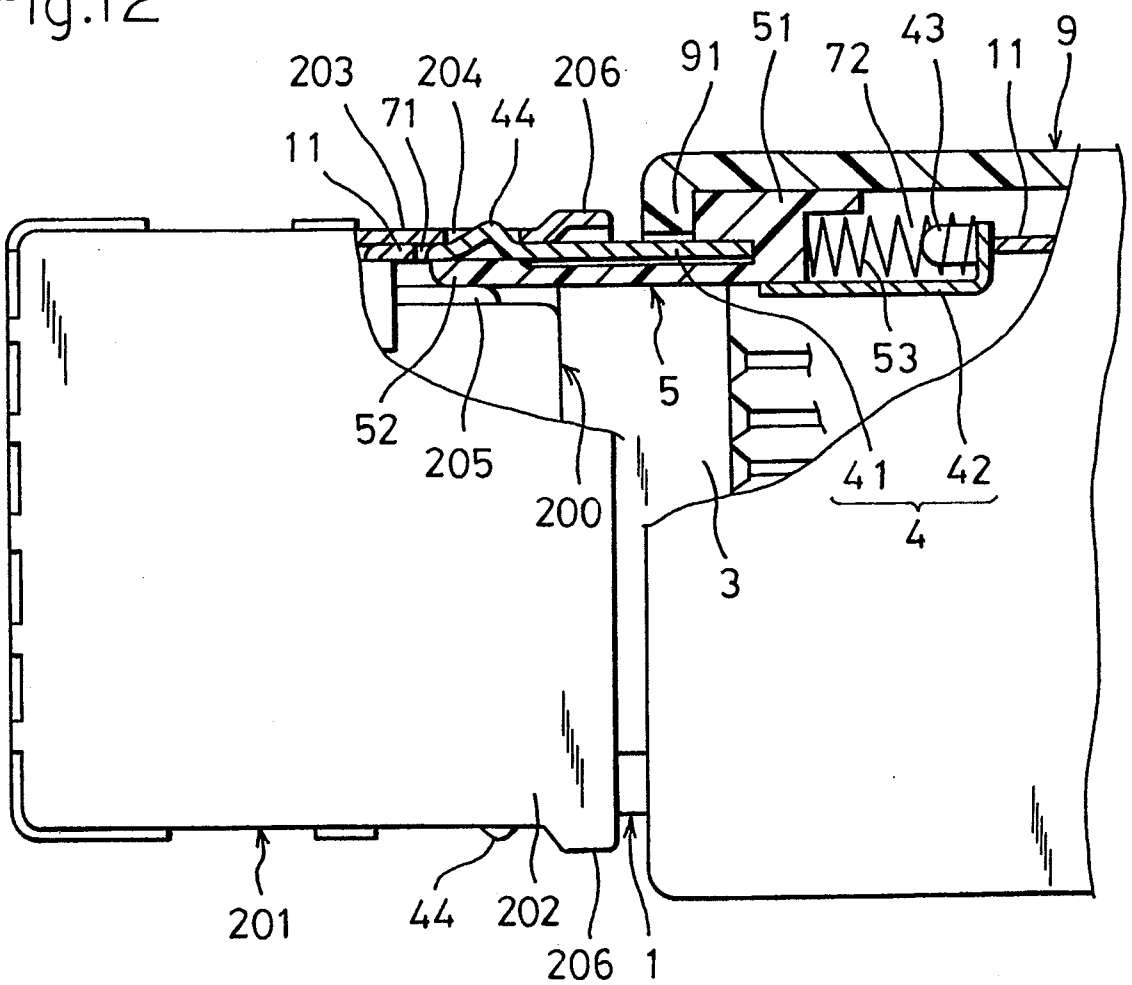
FIG. 12 is a view illustrating a further stage of the operation of connecting the plug-type multipolar electrical connector to the socket-type multipolar electrical connector.

For connecting the plug-type multipolar electrical connector to the socket-type multipolar electrical connector, the first shield cover 1 of the plug-type multipolar electrical connector is inserted into the shield cover 201 of the socket-type multipolar electrical connector in a direction shown by an arrow X. At the first stage, the projections 44 of the locking members 4 are guided by the guides 206 of the shield cover 201, so that the movable pieces 41 are inwardly displaced with the slide pieces 52 of the sliders 5. Immediately after the projections 44 have passed through the guides 206, the tips of the slide pieces 52 come in contact with the projecting portions 205 of the body 200 of the socket-type multipolar electrical connector, as shown in FIG. 10. When the plug-type multipolar electrical connector is further inserted, only the movable pieces 41 are moved forward as shown in FIG. 11, and the slide pieces 52 which remain in contact with the projecting portions 205, are prevented from being moved forward, so that the spring members 53 are compressed. When the plug-type multipolar electrical connector is further inserted in the direction X from the position shown in FIG. 11, the projections 44 reach the engagement holes 204 formed in the lateral plates 203 of the shield cover 201. At this time, the movable pieces 41 are outwardly reset due to the resiliency thereof, so that the projections 44 are fitted into the engagement holes 204. Thus, when the projections 44 are fitted into the engagement holes 204, gaps are formed between the movable pieces 41 and the projecting portions 205. Accordingly, after the slide pieces 52 are reset, the sliders 5 are pushed out by the spring loads of the spring members 53, so that the slide pieces 52 are fitted into the gaps as shown in FIG. 12. Accordingly, the slide pieces 52 are backed up from the back sides thereof by the projecting portions 205 to prevent the movable pieces 41 from being inwardly displaced. Accordingly, even though the composite cable 100 or the strain relief 8 is pulled, there is no possibility of the projections 44 coming out from the engagement holes 204. Thus, the plug-type multipolar electrical connector is prevented from unexpectedly coming out from the socket-type multipolar electrical connector.

The inserting operation mentioned above may be carried out with the sleeve 9 or the strain relief 8 of the plug-type multipolar electrical connector held with the hand. However, it is preferable to carry out the inserting operation with the sleeve 9 held with the hand, since the strain relief 8 does not have a space sufficient to be held with the hand.

Figure 13:
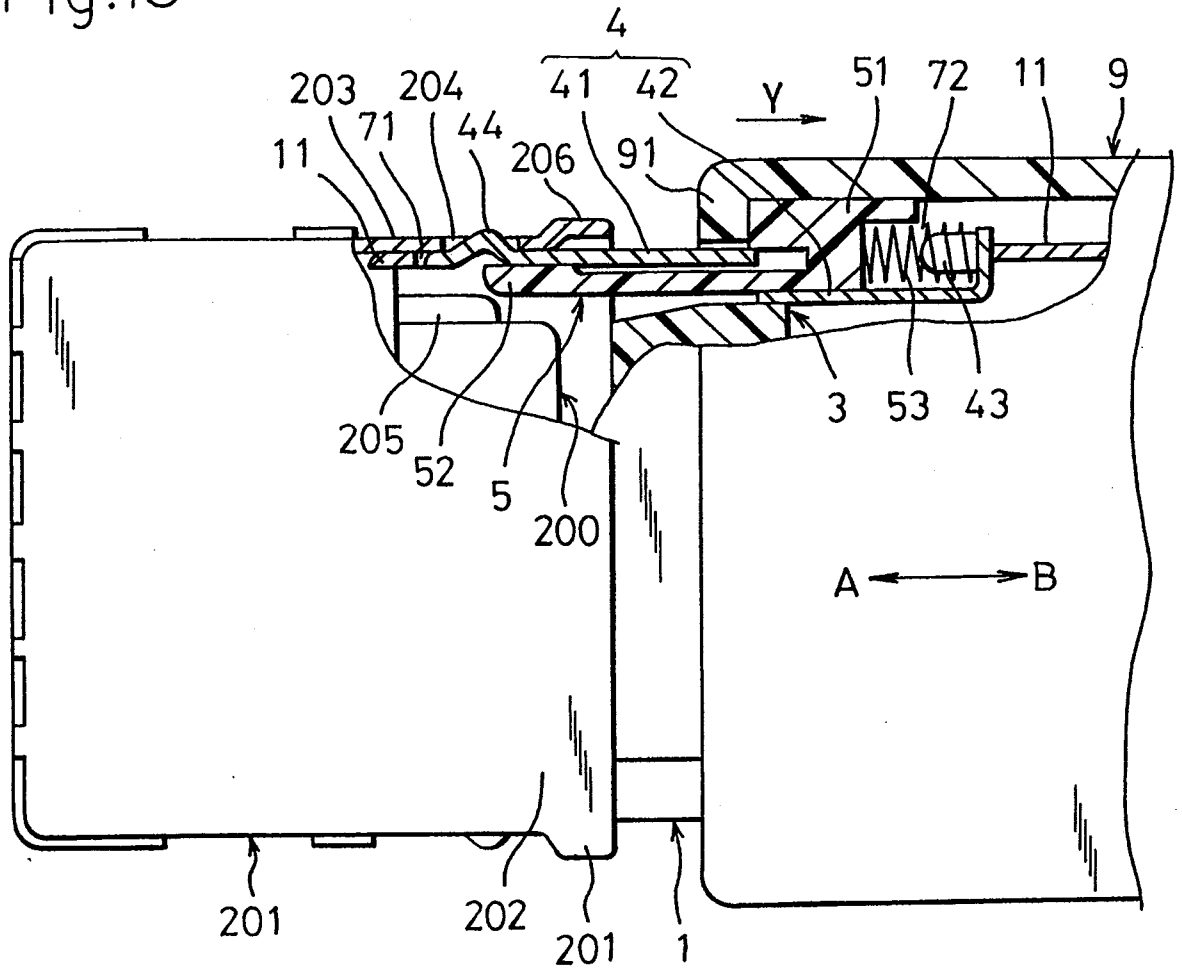
FIG. 13 is a view, with portions broken away, illustrating an operation of removing the plug-type multipolar electrical connector from the socket-type multipolar electrical connector.

For pulling out the plug-type multipolar electrical connector as connected to the socket-type multipolar electrical connector as shown in FIG. 12, from the socket-type multipolar electrical connector, the plug-type multipolar electrical connector can be pulled out in a direction shown by an arrow Y in FIG. 13 with the sleeve 9 held with the hand. At the first stage, the engagement portion 91 of the sleeve 9 engaged with the front ends of the base portions 51 of the sliders 5, pushes the base portions 51 in the rearward direction B (See FIG. 1), so that the sliders 5 are withdrawn against the spring loads of the spring members 53. Then, as shown in FIG. 13, the slide pieces 52 come out from between the projecting portions 205 and the movable pieces 41 to form gaps between the movable pieces 41 and the projecting portions 205. This enables the movable pieces 41 to be inwardly displaced. Accordingly, when the plug-type multipolar electrical connector is further pulled out, the pulling force causes the projections 44 to be inwardly pulled out from the engagement holes 204. Then, the movable pieces 41 and the first shield cover 1 are pulled out from the shield cover 201, so that the plug-type multipolar electrical connector is removed from the socket-type multipolar electrical connector.

As discussed in the foregoing, the plug-type multipolar electrical connector of the present invention is of the so-called one-touch full locking type that each of the inserting and pulling operations can be carried out by pushing or pulling the sleeve 9 as held with the hand. Accordingly, the plug-type multipolar electrical connector is convenient to use. Further, the projections 44 are engaged with the engagement holes 204 at the left- and right-hands of both electrical connectors, enabling the inserting and pulling operations to be carried out in a well balanced manner. Further, the locking members 4 are separated from the first shield cover 1, and the spring members 53 are housed in the holding frames 42 of the locking members 4. Accordingly, it is enough that the first shield cover 1 has only the openings 7 into which the locking members 4 are fitted, and it is not required to form openings through which the spring members 53 are disposed. This minimizes a decrease in shielding performance due to the formation of such openings.

What is claimed is:

1. A plug-type multipolar electrical connector having a body made of an insulating material in which a plurality of projecting terminal pins are assembled, said plurality of terminal pins comprising:

a terminal pin group for thin conductors in which a plurality of terminal pins are disposed at the center of said body with the horizontal pitch between each adjacent terminal pin being fine;

a terminal pin group for thick conductors in which a plurality of terminal pins are disposed at a lateral side of said terminal pin group for thin conductors with the horizontal pitch between each adjacent terminal pin being greater than the horizontal pitch between adjacent terminal pins of the terminal group for said thin conductors;

a first shield cover made of a metallic plate and so disposed as to surround the body, the terminal pin group for thin conductors and the terminal pin group for thick conductors;

a ring body fittingly placed on a composite cable in which a braided shell shield surrounds core wires comprising thin conductors and core wires comprising thick conductors; and a second shield cover having, in a unitary structure, an attaching neck portion fittingly placed on said ring body attached to said composite cable, a portion of said braided shell shield folded back on the outer surface of said ring body being held by and between said attaching neck portion and said ring body, and a fitting case portion extending from said attaching neck portion and fitted to said first shield cover, wherein:

said first shield cover has a rear end portion said rear end portion being fitted to the fitting case portion of the second shield cover;

said second shield cover having a rearward direction and engagement pawls which are cut and inwardly turned and which are opened in the rearward direction, said engagement pawls being engaged with corresponding engagement holes formed in said first shield cover; and said first shield cover has engagement pawls opened in the rearward direction, said engagement pawls being engaged with the front end edge of the fitting case portion, whereby said first shield cover is connected to said second shield cover.

2. A plug-type multipolar electrical connector having a body made of an insulating material in which a plurality of projecting terminal pins are assembled, said plurality of terminal pins comprising:

a terminal pin group for thin conductors in which a plurality of terminal pins are disposed at the center of said body with the horizontal pitch between each adjacent terminal pin being fine;

a terminal pin group for thick conductors in which a plurality of terminal pins are disposed at a lateral side of said terminal pin group for thin conductors with the horizontal pitch between each adjacent terminal pin being greater than the horizontal pitch between adjacent terminal pins of the terminal group for said thin conductors;

a first shield cover made of a metallic plate and so disposed as to surround the body, the terminal pin group for thin conductors and the terminal pin group for thick conductors;

a ring body fittingly placed on a composite cable in which a braided shell shield surrounds core wires comprising thin conductors and core wires comprising thick conductors;

a second shield cover having, in a unitary structure, an attaching neck portion fittingly placed on said ring body attached to said composite cable, a portion of said braided shell shield folded back on the outer surface of said ring body being held by and between said attaching neck portion and said ring body, locking members each having a front end and a base end, said locking members forming a unitary structure, with resilient movable pieces provided at the front ends thereto said resilient movable pieces having projection, and with holding frames at the base ends thereof, said holding frames having spaces for housing spring members;

sliders each forming a unitary structure, said sliders having base portions longitudinally movably fitted to a respect one of said holding frames of said locking members, said base portions having a front end, and slide pieces extending from said base portions throughout the back sides of said movable pieces in an overlapping manner;

spring members disposed in said spaces for housing spring members in said holding frames between said base, portions of said sliders and spring receiving portions formed at said holding frames, said spring members normally biasing said sliders in a forward direction;

a sleeve longitudinally slidably placed on and fitted to said first shield cover, said sleeve having an engagement portion which is engageable, only from the front side thereof, with the front ends of said base portions of said sliders: and a fitting case portion extending from said attaching neck portion and fitted to said first shield cover, wherein:

said first shield cover has a pair of lateral plates extending in the longitudinal direction;

said pair of lateral plates having openings formed therein, said openings defining rear end, edges and openings extending in the longitudinal direction of said lateral plates;

said locking members being fitted to said openings with said projections of said movable pieces projecting from said lateral plates of said first shield cover;

said holding frames of said locking members being engaged with the rear end edges of said openings; and the engagement portions of said front ends of said base portions of said sliders with said engagement portion of said sleeve, being located rearward with respect to said projections of said movable pieces.

3. A plug-type multipolar electrical connector according to claim 2, wherein the openings have forward narrow-width parts and rearward wide-width parts, the movable pieces of the locking members being housed in said narrow-width parts and the holding frames of said locking members being housed in said wide-width parts.

4. A plug-type multipolar electrical connector according to claim 2, wherein the lateral plates of the first shield cover have an outer surface around the openings, and wherein the holding frames of the locking members have pairs of upper and lower flat plates which form the spaces for housing spring members, and flange portions formed by bending said flat plates, said flange portions being opposite to and coming in contact with the outer surfaces around the openings of the lateral plates of the first shield cover.

5. A plug-type multipolar electrical connector according to claim 3, wherein the lateral plates of the first shield cover have an outer surface around the openings, and wherein the holding frames of the locking members have pairs of upper and lower flat plates which form the spaces for housing spring members, and flange portions formed by bending said flat plates, said flange portions being opposite to and coming in contact with the outer surfaces around the openings of the lateral plates of the first shield cover.

6. A plug-type multipolar electrical connector according to claim 2, further having a cover portion and a case portion for strain relief, said cover portion being placed on the second shield cover, said case portion covering the composite cable, the rear end portion of the sleeve slidably covering said cover portion of said strain relief.

* * * * *